US005387373A

United States Patent [19]

Naik

[11] Patent Number: 5,387,373

[45] Date of Patent: Feb. 7, 1995

[54] DETERGENT COMPOSITIONS

[75] Inventor: Appaya R. Naik, Birkenhead, United Kingdom

[73] Assignee: Unilever Patent Holdings B.V., Vlaardingen, Netherlands

[21] Appl. No.: 8,460

[22] Filed: Jan. 25, 1993

[30] Foreign Application Priority Data

Jan. 24, 1992 [GB] United Kingdom ..... 9201519

[51] Int. Cl.[6] ..... C11D 1/14; C11D 1/75; C11D 1/88

[52] U.S. Cl. ..... 252/546; 252/547; 252/550; 252/DIG. 14

[58] Field of Search ..... 252/550, 546, 547, DIG. 14

[56] References Cited

U.S. PATENT DOCUMENTS

| | | | |
|---|---|---|---|
| 3,928,249 | 12/1975 | Nuziata et al. | 252/526 |
| 4,076,653 | 2/1978 | Davies et al. | 252/532 |
| 4,671,894 | 6/1987 | Lamb et al. | 252/545 |
| 4,732,707 | 3/1988 | Naik et al. | 252/548 |

FOREIGN PATENT DOCUMENTS 0036625 9/1981 European Pat. Off. .

*Primary Examiner*—Paul Lieberman
*Assistant Examiner*—Erin M. Higgins
*Attorney, Agent, or Firm*—Cushman Darby & Cushman

[57] ABSTRACT

A stable aqueous detergent composition is provided in liquid or gel form containing from 10 to 80% by weight of an active detergent mixture comprising primary alkyl sulphate in an amount of 15 to 75% by weight of the active detergent plus betaine and/or amine oxide in an amount of 10 to 40% by weight of the active detergent mixture. Primary alkyl sulphate having chains of 10 or 11 carbon atoms provides at least 25% by weight of the primary alkyl sulphate present. The betaine and/or amine oxide is at least two thirds of the amount by weight of any primary alkyl sulphate having carbon atom chains of 12 carbon atoms or longer. The $C_{10}$ and/or $C_{11}$ alkyl sulphate is surprisingly effective as a detergent in such compositions despite higher water solubility than longer chain alkyl sulphate. It can enhance mildness compared to longer chain alkyl sulphate, and can replace or partially replace alkyl ether sulphate. Nonionic detergent may be included to enhance mildness further.

11 Claims, No Drawings

DETERGENT COMPOSITIONS

The present invention relates to liquid detergent compositions suitable for use especially, but not exclusively, in fabric washing, shampoos, and above all, in manual dishwashing operations in both hard and soft water.

The term "dishes" as used herein means any utensils involved in food preparation or consumption which may be required to be washed to free them from food particles and other food residues, greases, proteins, starches, gums, dyes, oils and burnt organic residues.

Light-duty liquid detergent compositions such as are suitable for use in washing dishes are well-known. Many of the formulations in commercial use at the present time are based on a sulphonate-type anionic detergent, especially an alkyl benzene sulphonate, in conjunction with an alkyl polyethoxy sulphate (alkyl ether sulphate). The sulphonate-type detergent generally predominates.

There have also been numerous proposals to formulate liquid detergent compositions using primary alkyl sulphate as anionic detergent active. A conventional source of primary alkyl sulphate is coconut alcohol. Naturally occurring coconut alcohol is a mixture which contains about 47% of molecules containing chains of 12 carbon atoms, about 19% of molecules with 14 carbon atoms and about 20% of molecules with chains of 16 or more carbon atoms. There is a small amount of material with chain lengths of 10 carbon atoms or less. Typically there is 5% with chains of 10 carbon atoms and 5% with chains of 8 carbon atoms. Coconut alcohol is generally used as a source of 12 and 14 carbon chain lengths. Other chain lengths present are regarded merely as impurities. Moreover supplies of coconut alcohol frequently do not include the shorter 8 and 10 carbon chain lengths because these shorter alcohols are often distilled out for sale separately.

Our EP-A-232153 discloses compositions prepared using primary alkyl sulphate of synthetic origin containing 12 and 13 carbon chains.

The use of conventional dishwashing liquids based on anionic detergents has been seen to have deleterious influence on the hand condition of the users. As a result mildness in washing-up liquid is considered as a desirable quality. There have been proposals to use primary alkyl sulphate jointly with a betaine or an amine oxide and also a nonionic detergent in order to obtain a formulation which achieves both good detergency and mildness to hands. Notably, our EP-A-232153 discloses compositions containing (i) primary alkyl sulphate, (ii) alkyl ether sulphate, (iii) alkanolamide, amine oxide or betaine and (iv) an ethxoylated nonionic detergent. Our EP-A-341071 discloses combinations of alkyl sulphate, betaine, and alkylpolyglycoside.

EP-A-155737 discloses low irritating shampoo compositions which contain betaine, anionic surfactants including lauryl sulphate and also a nonionic surfactant.

GB-2165855 discloses liquid detergent compositions in which a surfactant mixture contains more than 50% nonionic surfactant, an anionic surfactant which may be C12–C16 alkyl sulphate, betaine and alkanolamide.

Primary alkyl sulphates which have a chain length shorter than 12 carbon atoms are more water soluble than the longer chain analogues. Consequently they have higher critical micelle concentrations and would not be regarded as suitable for use as the anionic detergent in a liquid detergent composition.

Surprisingly, we have now found that liquid detergent compositions can be formulated using primary alkyl sulphate, betaine or amine oxide and possibly other detergent materials with the content of primary alkyl sulphate of 10 and 11 carbon chain lengths being greater than the impurity levels which may be present in coconut-derived primary alkyl sulphate.

Broadly therefore, the present invention provides a detergent composition in liquid or gel form containing from 10 to 80% by weight of an active detergent mixture and also containing water, the active detergent mixture comprising:

a) primary alkyl sulphate in an amount which is from to 15%, preferably 15 to 60%, by weight of the active detergent mixture, with at least 25%, preferably at least 40% of the primary alkyl sulphate present having alkyl chain lengths of 10 or 11 carbon atoms;

b) betaine and/or amine oxide in an amount which is to 40%, preferably 10 to 30%, by weight of the active detergent mixture and is also at least two thirds of the quantity by weight of any primary alkyl sulphate having chain lengths of 12 carbon atoms or more.

The primary alkyl sulphate may be provided predominantly or entirely by material with a chain length of 11 carbon atoms. Thus one possibility is to utilise primary alkyl sulphate of which at least 75% by weight has a chain length of 11 carbon atoms.

Primary alkyl sulphate with a chain length of 10 carbon atoms can be used, but it is preferred that this chain length is not used alone. On the contrary it is preferably accompanied by at least half its weight of primary alkyl sulphate with longer chain length, in the range from 11 to 15 carbon atoms. Preferably then, the quantity of betaine and/or amine oxide is at least two thirds the quantity of primary alkyl sulphate with 11 to 15 carbon atoms.

One useful possibility is a primary alkyl sulphate made so as to contain even numbers of carbon atoms. Then at least 25%, preferably at least 40%, of the primary alkyl sulphate may have a chain length of 10 carbon atoms, while at least 25%, better at least 40%, of the primary alkyl sulphate has chain lengths of 12 and 14 carbon atoms.

Within the broad scope of the invention there are several combinations of materials and proportions thereof which are preferred. One such combination concerns compositions containing nonionic detergent, as is also used in our EP-A- 232153, EP-A-341071 and EP-A-387063. For such a composition the active detergent mixture may contain primary alkyl sulphate as specified above,
betaine and/or amine oxide as specified above, and
a water soluble nonionic detergent in an amount of 10 to 70% by weight of the active detergent mixture.

The content of betaine and/or amine oxide in such a mixture preferably lies in a range from 10 to 30% by weight of the active detergent mixture.

The preferred quantity of primary alkyl sulphate in such a mixture is from 15 to 60% by weight of the active detergent mixture, especially 15 to 40%.

Compositions such as the foregoing in which the quantity of nonionic detergent is at least 20%, better at least 25%, even better at least 30%, of the detergent mixture may be compositions which achieve a good combination of detergency and mildness to hands. Hitherto compositions formulated to meet these joint objectives have very frequently contained a substantial proportion of alkyl ether sulphate. In these preferred compositions according to this invention the short chain primary alkyl sulphate having 10 or 11 carbon atom chains can serve to replace at least some of the alkyl ether sulphate. Some alkyl ether sulphate may be included, nevertheless.

Other anionic detergent active may be included but for certain forms of this invention the anionic detergent consists substantially exclusively of primary alkyl sulphate or primary alkyl sulphate with alkyl ether sulphate.

A different possibility within the scope of the present invention concerns compositions in which the content of nonionic detergent is not more than 30% of the active detergent mixture. Such compositions can achieve good detergency, in particular in cool water, and while they cannot be expected to achieve the same mildness as compositions containing over 30% of nonionic detergent, the incorporation of short chain alkyl sulphate having 10 and 11 carbon atoms leads to better mildness than would be the case using only longer chain alkyl sulphate.

In such compositions, primary alkyl sulphate with chain lengths of 10 or 11 carbon atoms is preferably at least 25% of the active detergent mixture, preferably at least 40%.

Materials used in this invention, and embodiments thereof, will now be discussed in turn.

Primary alkyl sulphate has the general formula $$ROSO_3X$$

where R is an alkyl group and X is a solubilising cation. Primary alkyl sulphates are available from a number of suppliers. They are made by sulphation of primary alcohols which can be derived in various ways.

One possible source of alcohols is coconut oil. The distribution of carbon chain lengths in coconut alcohol has already been mentioned. Palm kernel oil is similar. In this invention these natural sources can provide part of the primary alkyl sulphate but cannot provide sufficient of the shorter chain lengths which are characteristic of this invention unless the amount of these is enriched in some way which alters the chain length distribution.

Synthetic primary alcohols—usually mixtures—can be employed as a feed stock for sulphation. These may have a narrow range of chain lengths with odd and even numbers of carbon atoms, or a mixture with only even numbers.

One example of commercially available primary alkyl sulphates is Dobanol (Registered Trade Mark) 23A or 23S from Shell based on $C_{12}$ and $C_{13}$ primary alcohol (about 75% straight chain, 25% 2-methyl branched).

Another example is Lial (Registered Trade Mark) 123-S from Enichem, Italy which is based on branched chain $C_{12}$ and $C_{13}$ primary alcohol. Lial $C_{11}$-S is based on branched chain $C_{11}$ primary alcohol. Lial 145-S is based on branched chain $C_{14}$ and $C_{15}$ primary alcohol.

Empicol LX from Albright and Wilson is based on middle cut coconut alcohol.

Alfol 1412S from Conoco is based on a primary alcohol mixture derived from ethylene using a Ziegler catalyst. It contains $C_{14}$ and $C_{12}$ chains in approximately 2:1 ratio. Alfol C10–C12S is similar and contains approximately 85% $C_{10}$ chains.

Among the commercial materials referred to above, Lial C11-S and Alfol C10–C12S can provide the $C_{10}$ and/or $C_{11}$ primary alkyl sulphate required for this invention.

Alkyl ether sulphate is a mixture of materials of the general formula $$R—(OCH_2CH_2)_nOSO_3X.$$

wherein R is a $C_{10}$ to $C_{18}$ primary or secondary alkyl group, X is a solubilising cation, and n the average degree of ethoxylation, is from 1 to 5, preferably from 3 to 4. Particularly preferred values of n are 3 and 4. $R_3$ is preferably a $C_{10}$ to $C_{16}$ alkyl group. In any given alkyl ether sulphate, a range of differently ethoxylated materials, and some unethoxylated material, will be present and the value of n represents an average. The unethoxylated material is, of course, alkyl sulphate.

The amount of alkyl primary sulphate in any primary alkyl ether sulphate will depend on average degree of ethoxylation n. When n is 3, primary alkyl sulphate typically constitutes 15 to 20% of the mixture, and less than this when n is 4 or more. When the proportion of alkyl sulphate is low, it may prove convenient to ignore it. Nevertheless, it contributes to the content of primary alkyl sulphate in the overall detergent mixture. The conventional process of manufacture of secondary alkyl ether sulphates is such that there is only a very small quantity of alkyl sulphate in the product.

The solubilising cations of the anionic detergent actives are denoted as X in the formulae above. These may be any which provide the desired solubility of the anionic material. Monovalent cations such as alkali metal ions, ammonium and substituted ammonium are typical. Divalent ions giving adequate solubility may be used, and especially magnesium ions may be present to improve soft water performance and can be incorporated as magnesium salt of the anionic actives or as inorganic magnesium salts, or in the hydrotrope system.

Suitable betaines include simple betaines of formula

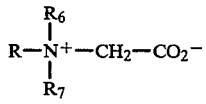

and amido betaines, also known as amido alkyl betaines, of formula:

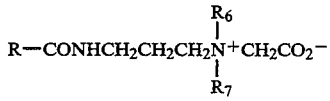

In both formulae R is a $C_8$ to $C_{18}$ straight or branched alkyl group. It may be a lauryl group or a middle cut coconut alkyl group. $R_6$ and $R_7$ are each $C_1$ to $C_3$ alkyl or $C_2$ to $C_3$ hydroxyalkyl.

Examples of sulphobetaines have the above formulae with $—CH_2CO_2^-$ replaced by

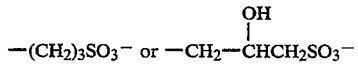

A suitable simple betaine is Empigen BB from Albright & Wilson. It has the formula quoted above in which R is $C_{12}$ to $C_{14}$ alkyl, derived from coconut, and $R_6$ and $R_7$ are both methyl. An example of amido betaine is Tego L7 from Goldschmidt, which has a whole coconut alkyl group.

Suitable amine oxides have the formula $$R\ R_6R_7N\rightarrow O$$

wherein R is a straight or branched chain $C_8$ to $C_{18}$ alkyl group and $R_6$ and $R_7$ are each $C_1$ to $C_3$ alkyl, or $C_2$ to $C_3$ hydroxyalkyl. A suitable amine oxide is Empigen OB from Albright & Wilson. In it R is middle-cut coconut alkyl and $R_6$ and $R_7$ are both methyl.

It is envisaged that a composition embodying this invention may include betaine as above substantially without amine oxide. The betaine may well then be amidobetaine of the formula $$R{-}CONHCH_2CH_2CH_2\overset{\overset{R_6}{|}}{\underset{\underset{R_7}{|}}{N}}{}^{+}CH_2CO_2^{-}$$

or a corresponding sulphobetaine in which $-CH_2CO_2^-$ is replaced with $-(CH_2)_3SO_3^-$ or $-CH_2CHOHCH_2SO_3^-$ so that this is present substantially without other betaine or amine oxide.

Nonionic detergent active may be a polyalkoxylated material, notably one or more ethoxylated nonionic detergent active materials. It is then desirable that such material should have an HLB value in the range from 12.0 to 16.0.

Such nonionic detergent may be a polyethoxylated aliphatic alcohol having an alkyl chain length of from $C_8$ to $C_{18}$ preferably $C_8$ to $C_{16}$, and an average degree of ethoxylation of from 4 to 14. Suitable nonionic detergents include short-chain high-foaming ethoxylated alcohols of the general formula $$R{-}(OCH_2CH_2)_m{-}OH$$

wherein R is an alkyl group, preferably straight-chain, having from 8 to 18 better 8 to 16 and yet more preferably 9 to 12, carbon atoms, and the average degree of ethoxylation m is from 5 to 14, more preferably 6 to 12. An especially preferred nonionic detergent is Dobanol 91-8 from Shell, for which R in the above formula is C9–$C_{11}$ (predominantly straight-chain) and m is 8, or alternatively Lialet $C_{11\text{-}10}$EO for which R is predominantly $C_{11}$ and m is 10.

Alternative suitable materials are those in which R is a secondary alkyl having from 8 to 18, preferably 11 to 15, carbon atoms and m is from 5 to 14, preferably 6 to 12. An example is Tergitol 15/ S/12 of Union Carbide (not available at present) or the material of the Softanol A series (from Japan Catalytic).

Preferably the polyethoxylated alcohol mixture is stripped to remove unethoxylated alcohol and reduce odour imparted to the composition.

Another possible nonionic detergent is an ethoxylated alkanolamide of the general formula $$R{-}CO{-}\underset{\underset{Y}{|}}{N}(R_8)(OCH_2CH_2O)_pH$$

wherein R is a straight or branched alkyl having from 7 to 18 carbon atoms, $R_8$ is an ethyleneoxy or propyleneoxy group Y is hydrogen or $-R_8(CH_2CH_2O)_qH$ P is 1 or more and q is 0, 1 or more R may be lauryl or coconut alkyl. Examples of ethoxylated alkanolamide are Amidox L5 and Amidox C5 from Stepan Chemical Company.

Nonionic detergent may be an alkyl polyglycoside of formula $$RO(G)_x$$

where R is a hydrophobic group containing approximately 8 to 20 carbon atoms, preferably about 8 to about 16, most preferably from 8 to 14, and G is a saccharide hydrophilic group. The value of x is denoting the number of saccharide units, is from about 1 to about 3, preferably 1 to 1.5, most preferably 1.2 to 1.4 saccharide units on average. The saccharide unit may be, for example, a galactoside, glucoside, fructoside or glycosyl. Mixtures thereof may be used.

Preferred alkyl polyglycosides are APG 300, APG 500 and APG 550 from Horizon (APG is a trademark). APG 300 and APG 500 have an average degree of polymerisation of 1.4, APG 550 has an average degree of polymerisation of 1.8. U.S. Pat. No. 4,599,188 (Lienado) gives further description and characterisation of alkyl polyglycosides.

Further possibilities for nonionic detergent are ethoxylated alkylphenols and ethoxylated fatty acids, i.e. polyethyleneglycol esters of fatty acids.

Optionally present within the active detergent mixture of the composition of the invention may be one or more mono- or dialkanolamides, preferably $C_8$ to $C_{18}$, more preferably $C_{10}$–$C_{18}$ carboxylic acid mono- or di($C_2$–$C_3$) alkanolamides. These have the general formulae $R_4{-}CO{-}NHR_5$ and $R_4{-}CO{-}N(R_5)_2$ respectively wherein $R_4$ is a $C_7$–$C_{17}$ aliphatic group, preferably straight-chain and preferably saturated, and $R_5$ is a hydroxyethyl or hydroxypropyl group. $R_5$ is preferably a 2-hydroxyethyl group.

Materials of this type are generally made from fatty acids of natural origin and contain a range of molecules having $R_4$ groups of different chain lengths; for example, coconut ethanolamides consist predominantly of $C_{12}$ and $C_{14}$ material, with varying amounts of $C_8$, $C_{10}$, $C_{16}$ and $C_{18}$ material. Preferred are ethanolamides derived from so-called middle cut coconut fatty acid, most preferably from lauric acid.

Although mono- and di-ethanolamides may be included in compositions of this invention, they are not essential and may be substantially absent, for example less than 2% of the active detergent mixture.

As well as the active detergent mixture and water, the liquid detergent compositions of the invention will generally need to contain one or more hydrotropes.

Hydrotropes are materials present in a formulation to control solubility, viscosity, clarity and stability but which themselves make no active contribution to the performance of the product. Examples of hydrotropes include lower aliphatic alcohols, especially ethanol; urea; lower alkylbenzene sulphonates such as sodium, toluene and xylene sulphonates and combinations of these. Preferred are alcohol, urea and xylene sulphonate. Hydrotropes are expensive and take up room in a formulation without contributing to its performance, and it is therefore desirable to use as small quantities of them as possible.

For example, the use of amine oxides as mentioned above requires a large amount of alcohol as hydrotrope. For this reason it is preferred to avoid the use of a substantial amount of any tertiary amine oxide in the present invention.

In preferred forms of this invention the weight of hydrotrope in the composition is not more than 12% of the weight of the active detergent mixture.

The compositions of the invention may also contain the usual minor ingredients such as perfume, colour, preservatives and germicides.

The stable liquid detergent compositions of the invention may be used for all normal detergent purposes especially where foaming is advantageous, for example, fabric washing products, general purpose domestic and industrial cleaning compositions, carpet shampoos, car wash products, personal washing products, shampoos, foam bath products, and above all, manual dishwashing.

The invention is further illustrated by the following non-limiting Examples in which all amounts of materials are by weight unless otherwise stated. It is envisaged that the various formulations could be made up as solutions containing 40% active detergent in water with hydrotrope also present if required.

EXAMPLES

The foaming performance and in some cases the mildness of various aqueous formulations were compared. Foaming performance was assessed by means of a modified Schlachter-Dierkes test based on the principle described in *Fette und Seifen* 1951, 53, 207. A 100 ml aqueous solution of each material tested, having a concentration of 0.04% active detergent (0.04% AD) in 5° H. or 24° H. water (French hardness) at 45° C. was rapidly oscillated using a vertically oscillating perforated disc within a graduated cylinder. After the initial generation of foam, increments (0.2 g) of soil (9.5 parts commercial cooking fat, 0.25 parts oleic acid, 0.25 parts stearic acid and 10 parts wheat starch in 120 parts water) were added at 15 second intervals (10 seconds' mild agitation and 5 seconds' rest) until the foam collapsed. The result was recorded as the number of soil increments (NSI score): a score difference of 3 or less is generally regarded as insignificant. Each result was typically the average of 3 or 4 runs. The test is referred to below as the "plunger test".

Several in-vitro and in-vivo methods for evaluating protein denaturation potency of surfactants and their mixtures have been reported (see Miyazowa et al, Int J Cos Sci 6 33–46 1984, and the references cited therein). One such method is the study of interaction of detergents with acid phosphatase enzyme either from skin (Protrey et al, Int J Cos Sci 6 263–273 1984) or from Wheatgerm (Tanaka et al, Anal Blochem 66 489–498 1975).

In vivo mildness of formulations can be assessed using a flex wash test. In this test neat products were rubbed on the forearm of panellists and rinsed. The process was repeated four times a day for five days and the level of erythema developed was assessed by trained assessors.

A comparison of wheatgerm acid phosphatase (WGAP) test and flex wash test results indicated that formulations giving less than 50% enzyme inhibition under the test conditions are substantially mild; any mildness differences between products giving <40% inhibition do not show any detectable mildness differences in flex wash test, indicating that the enzyme test is very sensitive and that in a real life situation there is a threshold level of protein denaturation below which all actives and products are indistinguishably mild. The WGAP test is used in some of these examples to assess mildness. The results of the WGAP test are expressed as percentage inhibition (i.e. 100% minus percentage activity remaining). Water gave no inhibition at all, i.e. 100% of activity remained.

Examples 1 to 4

Compositions were prepared with the formulations shown in the following table, which includes plunger test and WGAP test results. The amounts of materials are parts by weight based on the whole composition

| Example No: | 1 | 2 | 3 | 4 |
|---|---|---|---|---|
| Alfol C10-C12S | 15 | 10 | 10 | 10 |
| Lialet C11-1OEO | 15 | 16 | 16 | 14 |
| Lial 145-S | — | 4 | — | — |
| Empicol LX | — | — | 4 | 6 |
| Empigen BB | 6 | 6 | 6 | 6 |
| Empilan LME | 4 | 4 | 4 | 4 |
| $MgCl_2$ $6H_2O$ | 6 | 6 | 6 | 6 |
| Plunger Test (0.04% AD) | | | | |
| 24° H | 37 | 42 | 45 | 45 |
| 5° H | 32 | 49 | 48 | 50 |
| WGAP Test | | | | |
| % Inhibition | 7 | 22 | 11 | 19 |

Alfol is C10–C12S 85% $C_{10}$, 8.5% $C_{12}$, 6.5% $C_{14}$ alcohol sulphate

Lial 145-S is $C_{14}$–$C_{15}$ branched chain primary alcohol sulphate

Empicol LX is middle cut coconut alcohol sulphate

Lialet C11-10EO is $C_{11}$ branched chain primary alcohol 10EO

Empigen BB is $C_{12}$–$C_{14}$ alkyl dimethyl betaine

Empilan LME is acyl (mainly lauric) ethanolamide

Examples 5, 6 Comparative Examples A, B

Compositions were prepared with the formulations shown in the following table in which the amounts are parts by weight. The table includes plunger test and WGAP test results.

| Example No: | 5 | 6 | A | B |
|---|---|---|---|---|
| Lial 123-S | — | — | 15 | 5 |
| Lial C11-S | 15 | 15 | — | — |
| Lial et C11-1OEO | 15 | 15 | 15 | 15 |
| Lialet 123-3S | — | — | — | 10 |
| Empigen BB | 6 | — | 6 | 6 |
| Empigen OB | — | 6 | — | — |
| Empilan LME | 4 | 4 | 4 | 4 |
| $MgCl_2$ $6H_2O$ | 6 | 6 | — | — |
| Plunger Test (0.04% AD) | | | | |
| 24° H | 47 | 44 | 50 | 46 |
| 5° H | 51 | 52 | 67 | 45 |
| WGAP Test | | | | |
| % Inhibition | 31.5 | 16.5 | 60 | 23 |

Lial $C_{11}$-S is $C_{11}$ branched chain primary alcohol sulphate

Lial 123-S is $C_{12}$–$C_{13}$ branched chain primary alcohol sulphate

Lialet 123-3S is $C_{12}$ and $C_{13}$ alkyl ether sulphate with average three ethylene oxide residues per molecule Empigen OB is $C_{12}$–$C_{14}$ alkyl dimethyl amine oxide The preceding examples demonstrate a combination of good performance and mildness. Comparative example A gave better performance but was less mild. Comparative Example B provides comparison with a composition containing alkyl ether sulphate.

Examples 7 to 10

Compositions were prepared with the formulations shown in the following table, which also includes plunger test results. Amounts of materials are parts by weight.

| Example No: | 7 | 8 | 9 | 10 |
|---|---|---|---|---|
| Alfol 1412-S | 6 | 6 | — | — |
| Empicol LX | — | — | 6 | — |
| Lial C11-S | 6.5 | 6.5 | 6.5 | 12.5 |
| Lialet C11-1OEO | 6.5 | 6.5 | 6.5 | 6.5 |
| Tego L5351 | 6 | 6 | 6 | 6 |
| $MgCl_2$ $6H_2O$ | — | 3 | 3 | 3 |
| Plunger Test (0.04% AD) | | | | |
| 24° H | 42 | 43 | 39 | 36 |
| 5° H | 47 | 51 | 43 | 38 |

Tego L5351 is middle cut coconut alkyl amido betaine

Examples 11 to 14

Compositions were prepared with the formulations shown in the following table, which also includes plunger test results. Amounts in this table are parts by weight.

| Example No: | 11 | 12 | 13 | 14 |
|---|---|---|---|---|
| Empicol LX | 36 | 30 | 24 | 18 |
| Tego L5351 | 4 | 4 | 4 | 4 |
| Lial C11-S | — | 6 | 12 | 18 |
| $MgCl_2$ $6H_2O$ | 4 | 4 | 4 | 4 |
| Plunger Test (0.04% AD) | | | | |
| 24° H | 43 | 45 | 40 | 42 |

It can be seen that performance in the plunger test is maintained as Empicol LX is progressively replaced with the shorter chain Lial C11-S. Additionally it was observed that increasing proportions of Lial C11-S gave increasing solubility in water. The composition of Example 14 was soluble, at an active detergent concentration of 0.04% by weight, in 24° H. water at 20° C., giving a clear solution whereas the composition of Example 11 gave a cloudy suspension. Both gave clear solutions at the 45° C. temperature at which the plunger test is carried out.

It is desirable to avoid a cloudy suspension because some of the detergent is then out of solution and does not contribute to detergency. Therefore the composition of Example 14 is efficacious at lower temperatures than the composition of Example 11.

Example 15

A composition of the following formulation was prepared. The plunger test was carried out at a concentration of 0.034% active detergent by weight (this represents omission of some Empicol LX from Example 11).

| | |
|---|---|
| Empicol LX | 30 |
| Tego L5351 | 4 |

-continued

| | |
|---|---|
| Lial C11-S | — |
| $MgCl_2$ $6H_2O$ | 4 |
| Plunger Test (0.034% AD) | |
| 24° H | 36. |

I claim:

1. A stable detergent composition in liquid or gel form containing from 10 to 80% by weight of an active detergent mixture and also containing water, the active detergent mixture comprising:

primary alkyl sulphate in an amount of 15 to 75% by weight of the active detergent mixture betaine, amine oxide or mixtures thereof, in an amount of 10 to 40% by weight of the active detergent mixture and which is at least two thirds of the amount by weight of any primary alkyl sulphate having carbon atom chains of 12 carbon atoms or longer, wherein at least 75% by weight of the primary alkyl sulphate has a carbon atom chain length of 11 carbon atoms or at least 40% by weight of the primary alkyl sulphate has a chain length of 10 carbon atoms and in the latter case at least 25% by weight of the primary alkyl sulphate has a chain length of 12 to 14 carbon atoms.

2. A composition according to claim 1, wherein the amount of primary alkyl sulphate with chain lengths of 11 to 15 carbon atoms is at least half the amount with a chain length of 10 carbon atoms.

3. A composition according to claim 1, wherein the active detergent mixture contains a water-soluble nonionic detergent in an amount of 10% to 70% by weight of the active detergent mixture.

4. A composition according to claim 3, when the amount of nonionic detergent is from 25 to 50% by weight of the active detergent mixture.

5. A composition according to claim 3, wherein the amount of betaine is from 15 to 40% by weight of the active detergent mixture and the amount of primary alkyl sulphate is from 15 to 40% by weight of the active detergent mixture.

6. A composition according to claim 3, wherein the amount of primary alkyl sulphate is 25 to 60% by weight of the active detergent mixture, and the amount of betaine and/or amine oxide is 10 to 30% by weight of the active detergent mixture.

7. A composition according to claim 5, wherein the amount of primary alkyl sulphate having chain lengths of 10 and 11-carbon atoms is from 10 to 40% by weight of the active detergent mixture.

8. A composition according to claim 1, wherein the amount of nonionic detergent (if any) is not more than 30% by weight of the active detergent mixture and the amount of primary alkyl sulphate with chain lengths of 10 or 11 carbon atoms is at least 30% of the active detergent mixture.

9. A composition according to claim 1, containing betaine substantially without amine oxide.

10. A composition according to claim 1, containing an amido alkyl betaine substantially without other betaine or amine oxide.

11. A composition according to claim 1, further comprising not more than 2% of alkanolamide.

* * * * *

UNITED STATES PATENT AND TRADEMARK OFFICE

CERTIFICATE OF CORRECTION

PATENT NO. : 5,387,373

DATED : February 7, 1995

INVENTOR(S) : NAIK, Appaya R.

It is certified that error appears in the above-identified patent and that said Letters Patent is hereby corrected as shown below:

Claim 1, column 10, lines 13-14, delete "betaine, amine oxide or mixtures thereof," and insert -- ; --.

Claim 1, column 10, line 15, preceding "in an amount" insert --betaine, amine oxide or mixtures thereof--.

Signed and Sealed this

Thirty-first Day of October 1995

*Attest:*

Bruce Lehman

BRUCE LEHMAN

*Attesting Officer*

*Commissioner of Patents and Trademarks*